US006546737B1

(12) United States Patent
Heyes et al.

(10) Patent No.: US 6,546,737 B1
(45) Date of Patent: Apr. 15, 2003

(54) BEVERAGE COOLER

(75) Inventors: Keith James Heyes, Barnt Green (GB); Joseph Eugene Holland, Erdington (GB); William Robert Mooney, Alcester (GB)

(73) Assignee: IMI Cornelius Inc., Anoka, MN (US)

( * ) Notice: Subject to any disclaimer, the term of this patent is extended or adjusted under 35 U.S.C. 154(b) by 0 days.

(21) Appl. No.: 09/719,800

(22) PCT Filed: Jun. 14, 1999

(86) PCT No.: PCT/GB99/01872

§ 371 (c)(1),
(2), (4) Date: Mar. 1, 2001

(87) PCT Pub. No.: WO99/66273

PCT Pub. Date: Dec. 23, 1999

(30) Foreign Application Priority Data

Jun. 16, 1998 (GB) ..... 9812995

(51) Int. Cl.[7] ..... F25B 21/02; B67D 5/62
(52) U.S. Cl. ..... 62/3.64; 62/3.7; 62/389
(58) Field of Search ..... 62/3.2, 3.7, 3.64, 62/389, 390; 222/146.6

(56) References Cited

U.S. PATENT DOCUMENTS 2,931,188 A * 4/1960 Levit ..... 62/3.7
3,262,492 A * 7/1966 Meenan ..... 62/3.7
4,829,771 A * 5/1989 Koslow et al. ..... 62/3.64
5,314,586 A * 5/1994 Chen ..... 202/177

* cited by examiner

*Primary Examiner*—William C. Doerrler
(74) *Attorney, Agent, or Firm*—Sten Erik Hakanson

(57) ABSTRACT

Cooler for a beverage, e.g. beer, which enables dispense at low temperature with good appearance of the dispensed beverage, comprises an inlet and an outlet, at least one heat exchanger (10, 30, 32) between the inlet and the outlet through which the beverage can be passed to cool it and at least one Peltier plate assembly (12, 14, 42) connected to a voltage supply whereby a cold side and a hot side may be generated at the assembly, characterised in that the assembly (12, 14) is positioned whereby the beverage can also be cooled by passage past the cold side of the assembly (12, 14) on its passage to the outlet or whereby the coolant after passage through the heat exchanger (32) is cooled by passage past the cold side of the assembly (42) before being recirculated to the heat exchanger (32).

10 Claims, 2 Drawing Sheets

BEVERAGE COOLER

Figure 1:
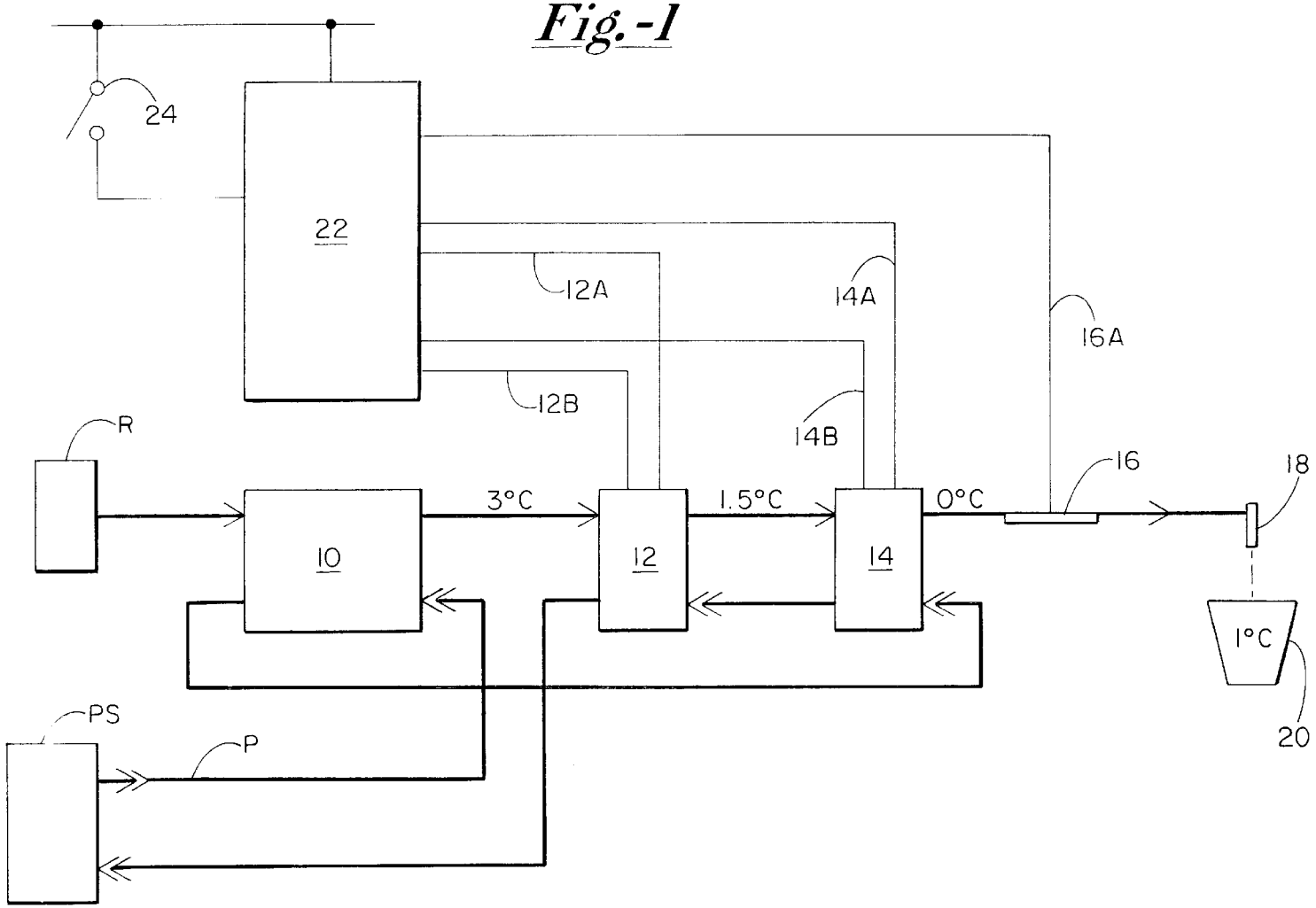

This invention relates to the cooling of beverages. In particular it relates to the cooling of alcoholic beverages such as beers which may need to be cooled to relatively low temperatures such as about 0° C. at the point of dispense.

Although not limited to the cooling of beers, the invention will for convenience be described below with particular reference to beers.

Cooling of beers to temperatures as low as about 0° C. and dispensing at that low temperature have proved difficult to achieve with conventional dispense technology and this can deleteriously affect the appearance and presentation of the beer.

It is an object of the invention to provide an improved means of cooling beverages, particularly beer, to such low temperatures.

Accordingly, the invention provides an apparatus for cooling a beverage, the apparatus comprising an inlet and an outlet, at least one heat exchanger between the inlet and the outlet through which the beverage can be passed to cool it, and at least one Peltier plate assembly connected to a voltage supply whereby a cold side and a hot side may be generated at the assembly, the assembly being positioned whereby the beverage can also cooled by passage past the cold side of the assembly on its passage to the outlet or whereby the coolant after passage through the heat exchanger is cooled by passage past the cold side of the assembly before being recirculated to the heat exchanger.

The inlet may conveniently be connected to a source or reservoir of the beverage, e.g. a keg of beer, and the beverage may be passed to the inlet by conventional means, e.g. by pumping or under gas pressure.

The heat exchanger may be cooled, for example, by connection to a conventional python to pass cooled water through it.

The outlet may include a dispense point for the beverage or may be connectable to an existing dispense point.

In a first embodiment of the invention the beverage is cooled directly by the Peltier plate assembly and in a second embodiment of the invention the beverage is cooled in a heat exchanger by means of a coolant that has been cooled by the Peltier plate assembly.

It is, of course, possible to combine both embodiments of the invention so that the beverage is cooled directly by Peltier plate assembly and is also cooled in a heat exchanger by means of a coolant that has been cooled by another or the same Peltier plate assembly.

In the first embodiment, the beverage is preferably passed through a series of cooling stages so that its temperature, in the example of beer, may be reduced from, say, 6° C. in the source or reservoir to the desired about 0° C. Thus, in a particularly preferred specific embodiment, the beverage from the source may first be passed through a heat exchanger to reduce its temperature from, say, 6° C. to 3° C., then past the cold side of a first Peltier plate assembly to reduce its temperature further to, say 1.5° C., and then finally past the cold side of a second Peltier plate assembly to reduce its temperature to, say, 0° C. whereby the final desired dispense temperature of, say, 1° C. in the glass may be achieved.

In this embodiment the coolant pumped through the heat exchanger may conveniently be cold water from a conventional python.

It will be appreciated that the number and order of the cooling stages may be changed to suit particular circumstances.

In the second embodiment, the beverage is preferably passed from the reservoir through two successive heat exchangers and then to the dispense point. The coolant in the first heat exchanger may be python water and the coolant in the second heat exchanger may be, for example, a glycol/water mixture which is circulated past the cold side of the Peltier plate assembly and then through the second heat exchanger.

In a particularly preferred arrangement of the second embodiment, the python water is circulated through the first heat exchanger and then past the hot side of the Peltier plate assembly before returning to the python for cooling and then passage again to the first heat exchanger. In this arrangement, for beer, the beer may be cooled from about 6° C., for example, to about 3° C. on exiting the first heat exchanger and then to about 0° C. on exiting the second heat exchanger so that it can then be dispensed at about 1° C. The python water in this example maybe at about 5° C. or 6° C. on exiting the first heat exchanger and is still sufficiently cool to extract further heat from the hot side of the Peltier plate assembly before returning to the python.

The coolant, e.g. glycol/water mixture, in this second embodiment may be circulated from a reservoir, kept, for example, at about −2° C. and linked to the Peltier plate assembly by temperature sensor and control means, known per se, to control the rate of flow to the desired temperature.

Again, it will be appreciated that the number and order of the cooling stages may be changed to suit particular circumstances.

The second embodiment described above may need to be run continuously for periods of time to ensure that the reservoir of coolant (glycol/water) is kept sufficiently cold to cope with peaks of beverage dispensing, i.e. a succession of drinks being dispensed. On the other hand the first embodiment described above is particularly suited to providing very rapid cooling of the beverage and so need be activated only by the activation of the dispense point.

The apparatus of the invention may also be utilised in systems in which the beverage is recirculated to and from the dispense point so that it does not stand for any length of time in the pipework or any reservoir where its condition could deteriorate.

The Peltier plate assemblies for use in the invention are well known per se and comprise a form of thermoelectric heat pump in which the passage of direct current through the plate assembly causes one side of the assembly to cool and the opposite side to heat up.

Conventional pythons are also well known per se.

The invention provides effective means of dispensing cooled beverages with a number of advantages.

There is a minimised risk of contamination of the beverage;

The apparatus can be designed to suit a large range of dispense throughput for a particular time period.

A separate cooled reservoir of the beverage is not required and the beverage, particularly beer, is less likely to suffer deterioration in the cooling/dispensing process.

There may be no heat output in the dispense area.

The cooling apparatus has few or no moving parts and is easy to clean.

The apparatus can be fitted as original equipment in a new dispense arrangement or can readily be retro-fitted into an existing arrangement.

It utilises existing technology in a novel, advantageous manner.

Figure 2:
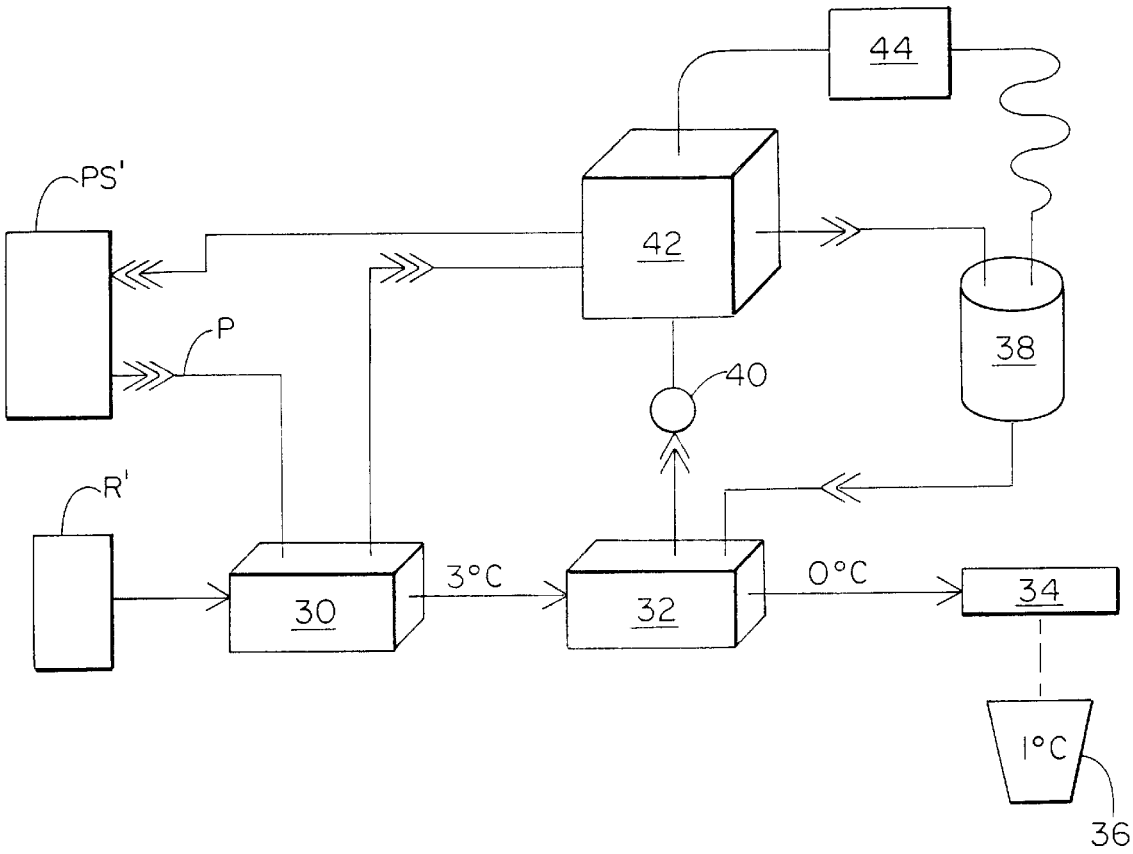

Embodiments of the invention will now be described by way of example only with reference to the accompanying drawings in which:

FIG. 1 is a schematic illustration of one beverage cooling and dispense apparatus according to a first embodiment of the invention; and FIG. 2 is a similar illustration of another beverage cooling and dispense apparatus according to a second embodiment of the invention.

In FIG. 1 is shown an apparatus for cooling beer, the flow of beer being indicted by single-headed arrows and the flow of coolant by double-headed arrows.

Beer at about 6° C. is pumped from a reservoir (not shown) through a heat exchanger 10. From the heat exchanger, where it emerges at about 3° C., it is pumped past the cold side of a first Peltier plate assembly 12 from where it emerges at about 1.5° C. From there it is pumped past the cold side of a second Peltier plate assembly 14 from where it emerges at about 0° C. It then passes through a flow sensor 16 to a dispense tap 18 where it can be dispensed into a glass 20 at a temperature of about 1° C.

The Peltier plate assemblies 12 and 14 are connected by lines 12A, 14A respectively to a control and power supply 22 which can provide low voltage DC current to the assemblies. Sensor 16 is also connected by line 16A to control 22 whereby the current can be switched on and off and the assemblies activated as required by each beer dispense that is activated and then completed at tap 18.

Cold python water, e.g. at 1° C. to 3° C. from a python (not shown) is introduced as the coolant into heat exchanger 10 to effect the initial cooling of the beer. After passing through the heat exchanger, the python water is passed past the hot side of Peltier plate assembly 14 and then past the hot side of Peltier plate assembly 12 before returning to the python. Thus the python water is colder passing assembly 14 than assembly 12.

The python water may be circulated, for example, at a rate of at least 4 litres/minute but it will be appreciated that this value and the above temperatures are for illustration purposes only.

When the apparatus of FIG. 1 is not being used to dispense the beer, the coolant water passing through the system, which may be at a temperature of up to, say 3° C., may have a warming effect on the Peltier plate assemblies 12 and 14. A temperature sensor (not shown) may, therefore, be placed in each assembly and connected to the control unit 22, as indicated by lines 12B, 14B respectively. The control unit is preprogrammed to provide any necessary trickle feed of current to the assemblies 12, 14 to maintain them at the desired temperature.

To protect against the possibility that the beer might freeze in the system, particularly at one of the Peltier plate assemblies, the control unit 22 may also be provided with a de-frost means 24, which can be activated to reverse temporarily the Peltier effect and thereby warm up the normally cold side of either or both assemblies to unfreeze the beer.

In FIG. 2 is shown another apparatus for cooling beer, the flow of beer again being indicted by single-headed arrows.

Beer at about 6° C. is pumped from a reservoir (not shown) through a first heat exchanger 30 from which it emerges at about 3° C. It is then pumped through a second heat exchanger 32 from which it emerges at about 0° C. From there it is pumped to a dispense tap 34 from which it can be dispensed into a glass 36 at about 1° C.

The beer in heat exchanger 30 is cooled by python water from a python (not shown). The flow of the python water is indicated by triple-headed arrows. The beer in heat exchanger 32 is cooled further by a glycol/water coolant from a glycol reservoir 38. The flow of this glycol/water coolant is indicated by double-headed arrows. It is pumped by means of a pump 40 to circulate from the reservoir 38, through the heat exchanger 32 and then past the cold plate of a Peltier plate assembly 42 and back to reservoir 38. The glycol/water temperature in reservoir 38 may be maintained at about −2° C. and its temperature may be monitored and controlled by control unit 44, which also supplies low voltage DC current to the Peltier plate assembly 42.

As shown, the python water on exiting heat exchanger 30 is passed to the Peltier plate assembly 42 where it passes into contact with and cools the hot side of the assembly.

The glycol/water reservoir can be of any volume chosen to suit the particular circumstances. For example, it may be of 4 to 5 litres and the Peltier plate assembly may be of 80 watts capacity or more but it will also be apparent that increasing the size of the glycol/water reservoir can lead to increased performance. Moreover, the use of the python water to give an initial cooling of the beer increases the dispense capacity using a Peltier assembly of a given, e.g. 80 watts, capacity and, indeed may double that capacity. The python water may be circulated, as in FIG. 1, at a rate of at least 4 litres/minute.

Again, it will be appreciated that the numerical values given are for illustration purposes only.

The invention is not limited to the embodiments shown.

For example the arrangements of FIGS. 1 and 2 may be altered by use of a manifold to supply coolant to the heat exchangers and Peltier plate assemblies, whereby they can be arranged in parallel instead of in series.

The heat exchangers and Peltier plate assemblies may be fitted inside a single container for ease of fitment to the beverage dispense line, for convenience and to save space.

In an arrangement such as shown in FIG. 1, for example, units 10, 12 and 14 can be joined together to form a single integral unit.

What is claimed is:

1. A fluid dispenser for cooling a fluid to a temperature close to a predetermined desired dispense temperature, comprising:

a reservoir of a first liquid coolant, the first liquid coolant circulated to and from the reservoir through a coolant conduit, the coolant conduit providing for a flow of the liquid coolant from the reservoir to a first heat exchanger and to a second heat exchanger, the second heat exchanger including a thermoelectric device having a cold side and a hot side and the coolant liquid in heat exchange contact with the hot side thereof, a reservoir of the fluid to be cooled and a fluid conduit extending there from to the first heat exchanger to provide for heat exchange cooling of the fluid by the liquid coolant and the fluid conduit providing for flow of the liquid from the first heat exchanger to the second heat exchanger for providing heat exchange contact between the fluid and the cold side of the thermoelectric device, and the second heat exchanger cooling the fluid by an amount less than or equal to the temperature reduction thereof provided by the first heat exchanger to thereby closely approach the predetermined desired dispense temperature, and the fluid conduit flowing from the second heat exchanger to a dispense point from which the fluid can be dispensed.

2. The dispenser as defined in claim 1, and further including a control for regulating the operation of the thermoelectric device as a function of a sensed temperature thereof as determined by a temperature sensor therein.

3. The dispenser as defined in claim 1, and further including a control for regulating the operation of the thermoelectric device as a function of a sensed volume of fluid dispensed from the dispense point as determined by a flow sensor.

4. The dispenser as defined in claim 1, and further including a control for regulating the operation of the thermoelectric device as a function of a sensed temperature thereof as determined by a temperature sensor therein and the control also regulating the operation of the thermoelectric device as a function of a sensed volume of fluid dispensed from the dispense point as determined by a flow sensor.

5. The dispenser as defined in claim 1, and further including a third, heat exchanger, the third heat exchanger also including a thermoelectric device having a cold side and a hot side and the coolant conduit providing for a flow of liquid coolant to the third heat exchanger for heat exchange contact with the hot side of the thermoelectric device thereof and the third heat exchanger reducing the temperature of the fluid by an amount less than or equal to the temperature reduction thereof provided by the second heat exchanger to thereby further closely approach the predetermined desired dispense temperature.

6. The dispenser as defined in claim 5, and further including a control for regulating the operation of the thermoelectric devices of both the second and third heat exchangers as a function of a sensed temperatures thereof as determined by temperature sensors therein.

7. The dispenser as defined in claim 5, and further including a control for regulating the operation of the thermoelectric devices of the first and second heat exchangers as a function of a sensed volume of fluid dispensed from the dispense point as determined by a flow sensor.

8. The dispenser as defined in claim 5, and further including a control for regulating the operation of the thermoelectric devices of both the second and third heat exchangers as a function of a sensed temperatures thereof as determined by temperature sensors therein and the control also regulating the operation of the thermoelectric devices of the first and second heat exchangers as a function of a sensed volume of fluid dispensed from the dispense point as determined by a flow sensor.

9. A fluid dispenser for cooling a fluid to a temperature close to a predetermined desired dispense temperature, comprising:

a reservoir of a first liquid coolant, the first liquid coolant circulated to and from the reservoir through a coolant conduit, the coolant conduit providing for a flow of the liquid coolant from the reservoir to a first heat exchanger and to a second heat exchanger, the second heat exchanger including a thermoelectric device having a cold side and a hot side and the coolant liquid in heat exchange contact with the hot side thereof, a coolant reservoir for containing a volume of liquid coolant the liquid coolant circulated there from to a third heat exchanger and to the cold side of the thermoelectric device for heat exchange cooling of the liquid coolant, a reservoir of the fluid to be cooled and a fluid conduit extending there from to the first heat exchanger to provide for heat exchange cooling of the fluid by the liquid coolant and the fluid conduit providing for flow of the liquid from the first heat exchanger to the third heat exchanger for providing heat exchange contact between the fluid and the liquid coolant, and the third heat exchanger cooling the fluid by an amount less than or equal to the temperature reduction thereof provided by the first heat exchanger to thereby closely approach the predetermined desired dispense temperature, and the fluid conduit flowing from the third heat exchanger to a dispense point from which the fluid can be dispensed.

10. The fluid dispenser as defined in claim 9, and further including a control for monitoring the temperature of the thermoelectric device and of the liquid coolant in the liquid coolant reservoir for regulating the temperature of the liquid coolant.

* * * * *